US005403069A

United States Patent [19]

Inara et al.

[11] Patent Number: 5,403,069

[45] Date of Patent: Apr. 4, 1995

[54] LUMBAR SUPPORT DEVICE

[75] Inventors: Yasuhisa Inara, Handa; Yukifumi Yamada; Hidetoshi Nakane, both of Toyota, all of Japan

[73] Assignee: Aisin Seiki Kabushiki Kaisha, Kariya, Japan

[21] Appl. No.: 126,207

[22] Filed: Sep. 24, 1993

[30] Foreign Application Priority Data

Sep. 24, 1992 [JP] Japan ..... 4-255012

[51] Int. Cl.[6] ..... B60N 2/02

[52] U.S. Cl. ..... 297/284.4; 297/284.8

[58] Field of Search ..... 297/284.4, 284.8

[56] References Cited

U.S. PATENT DOCUMENTS 4,886,316 12/1989 Suzuyama et al. ..... 297/284.4
5,286,087 2/1994 Elton ..... 297/284.8

FOREIGN PATENT DOCUMENTS 3336349 4/1985 Germany .
3616155 11/1987 Germany ..... 297/284.4
4038345 3/1992 Germany .
141341 5/1990 Japan ..... 297/284.4
3-53157 5/1991 Japan .

*Primary Examiner*—Laurie K. Cranmer
*Attorney, Agent, or Firm*—Fisher & Associates

[57] ABSTRACT

A lumbar support device includes a seat-back having a first upstanding frame and a second upstanding frame spaced therefrom in the lateral direction, a bilateral asymmetrical torsion spring having a first end portion which is rotatably supported by the first upstanding frame and a second end portion, a supporting plate mounted on the bilateral asymmetrical torsion spring, and a driving device disposed between the second upstanding frame and the second end portion of the bilateral asymmetrical torsion spring for moving the bilateral asymmetrical torsion spring in the direction of the thickness of the seat-back, wherein a degree of a deformation of the first end portion of the bilateral asymmetrical torsion spring is less than that of the second end portion of the bilateral asymmetrical torsion spring.

5 Claims, 6 Drawing Sheets

LUMBAR SUPPORT DEVICE

BACKGROUND OF THE INVENTION

1. Field of the Invention

The present invention relates to a lumbar support device which supports a portion of the back side of an occupant by urging a force thereto.

2. Description of the Prior Art

In Japanese Utility Model Laid-Open Print No. 3-53157 published in 1991 without examination, a conventional lumbar support device is disclosed. The conventional device includes a seat-back having a first upstanding frame and a second upstanding frame which are spaced with respect to each other in the lateral direction; a torsion spring having a first end portion, rotatably supported by the first upstanding frame, and a second end; a supporting plate mounted on the torsion spring, and a driving means disposed between the second end portion of the torsion spring and the second upstanding plate. The supporting plate is expected to be moved toward the back portion of an occupant along the direction of a thickness of the seat-back when the driving means is rotated in order to adjust thickness of the seat-back when the driving means is rotated in order to adjust the supporting force to be applied to the back portion of the occupant.

In the conventional device, the first end portion of the torsion spring is movable relative to the first upstanding frame due to the fact that the former is loosely received in a hole formed in the latter, and the second end of the torsion spring is, as it were, due to the existence of the driving means, fixedly connected to the second upstanding frame. Thus, under such structure, when the supporting plate supports the back portion of the occupant, the degree of deformation of the first end portion of the torsion spring becomes larger than that of the second end portion of the torsion spring. This results in that uneven supporting forces are applied by way of the supporting plate to the backside of the occupant, by which the occupant sometimes may feel discomfort.

SUMMARY OF THE INVENTION

It is therefore an object of the present invention to provide a lumbar support device without the aforementioned drawback.

It is a further object of the present invention to provide a lumbar support device in which even supporting forces are applied by way of the supporting plate to the backside of the occupant.

In order to achieve these objects, there is provided a lumbar support device including a seat-back having a first upstanding frame and a second upstanding frame spaced therefrom in the lateral direction; a bilateral asymmetrical torsion spring having a first end portion, which is rotatably supported by the first upstanding frame, and a second end portion; a supporting plate mounted on the bilateral asymmetrical torsion spring; and a driving device disposed between the second upstanding frame and the second end portion of the bilateral asymmetrical torsion spring for moving the bilateral asymmetrical torsion spring in the direction of the thickness of the seat-back; wherein a degree of a deformation of the first end portion of the bilateral asymmetrical torsion spring is less than that of the second end portion of the bilateral asymmetrical torsion spring.

BRIEF DESCRIPTION OF THE DRAWINGS

Additional objects and advantages of the present invention will become more apparent from the following detailed description of preferred embodiments thereof when considered with reference to the attached drawings, in which.

DETAILED DESCRIPTION OF THE PREFERRED EMBODIMENT

Figure 1:
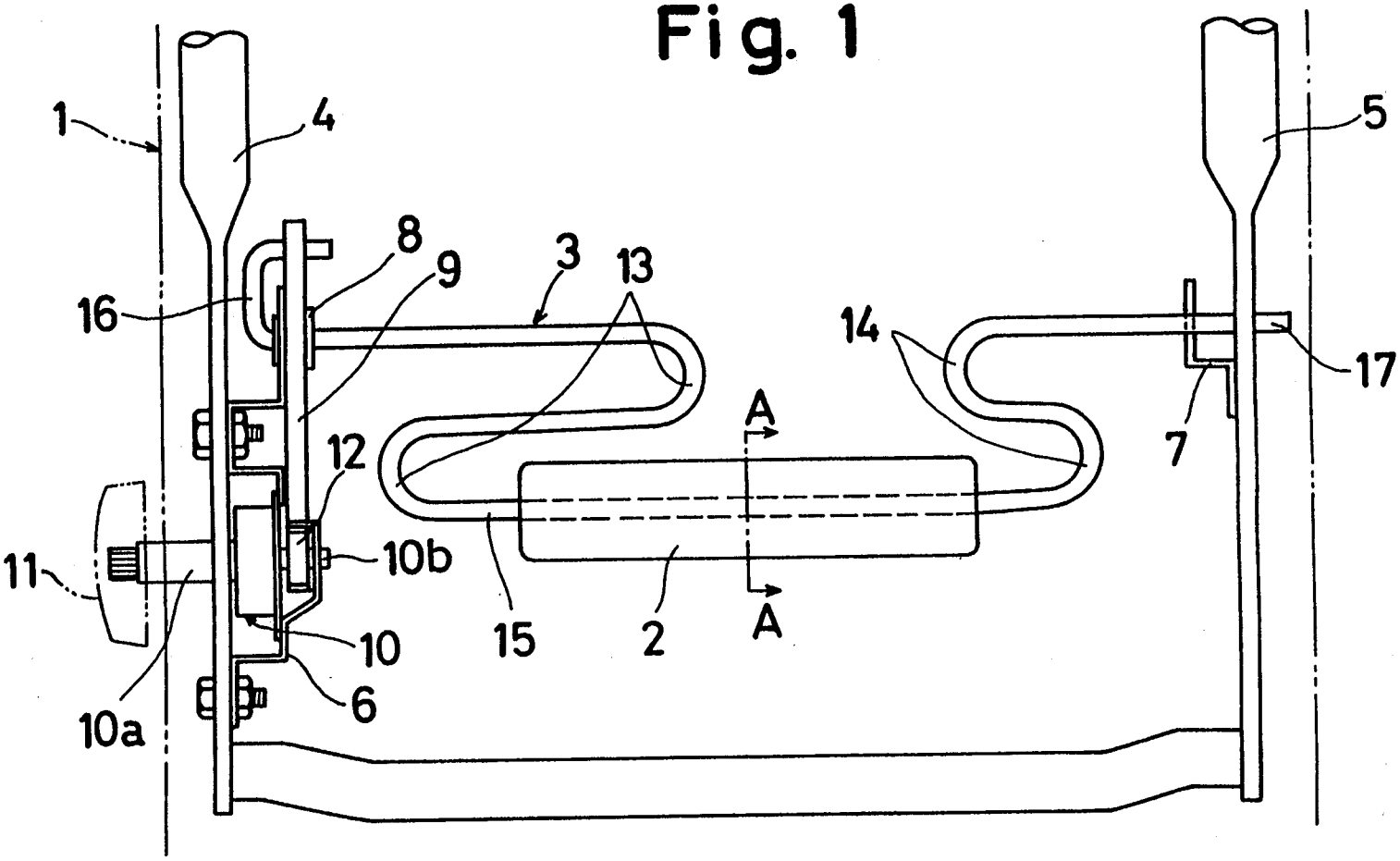
FIG. 1 is a front view of a first embodiment of a lumbar support device in accordance with the present invention.
Figure 2:
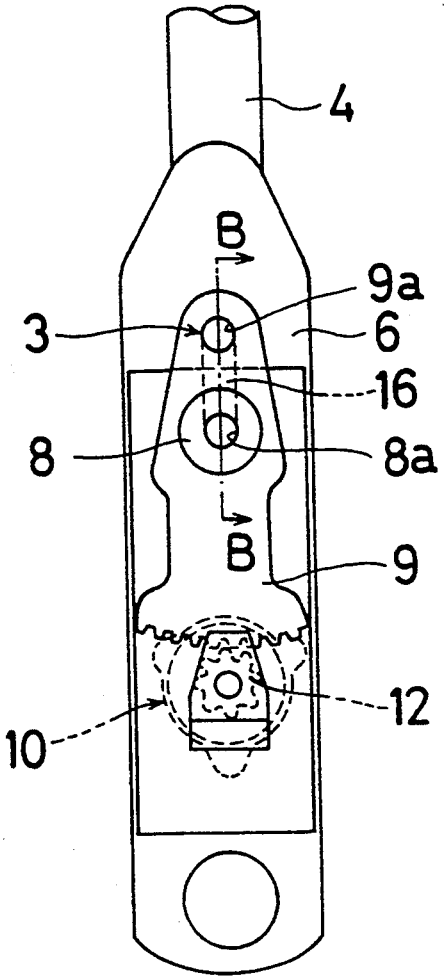
FIG. 2 is a side view of the lumbar support device shown in FIG. 1.
Figure 3:
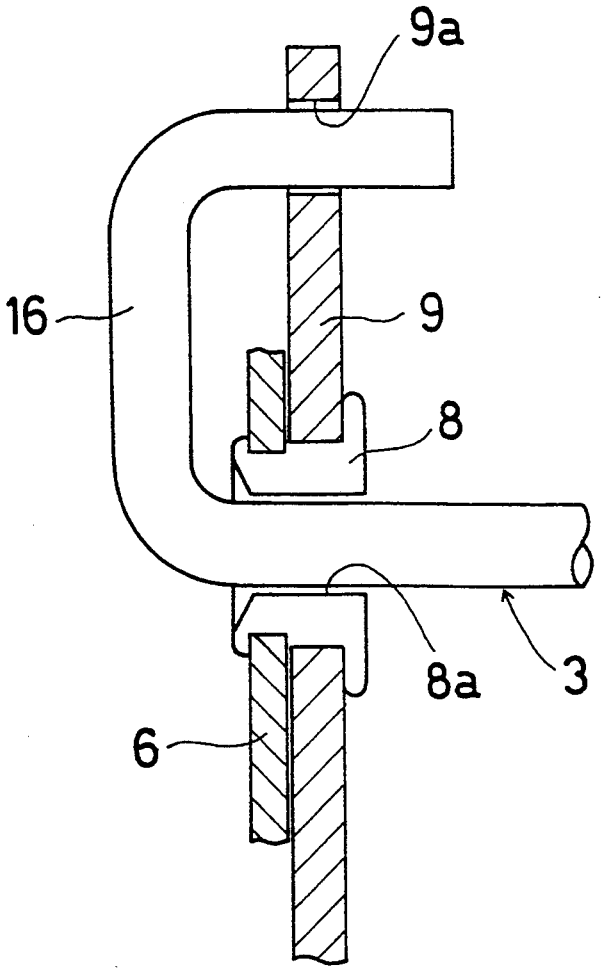
FIG. 3 is a cross-sectional view taken along line B—B in FIG. 2.

Referring to FIGS. 1 through 3 inclusive, a seat-back 1 includes side frames 4 and 5. A torsion bar 3, on which a support plate 2 is mounted, is supported, as will be detailed later, by side frames 4 and 5.

A bracket 6 and a bracket 7 are secured to the side frame 4 and the side frame 5, respectively. A sector-gear 9 is rotatably mounted on the bracket 6 by way of a bushing 8 which has a hole **8*a* therein. The bracket 6 is also provided with a braking mechanism 10 which is in the form of a well-known spring coupler. An input shaft 10*a* of braking mechanism 10 is extended outwardly and is secured with a knob or handle 11 at a side of the seat-back 1. An output shaft 10*b* of the braking mechanism 10 is connected with a pinion gear 12 which is in meshing engagement with the sector-gear 9**.

The torsion bar 3 is accommodated within the seat-back 1 and is extended along the lateral direction of the seat-back 1. One end portion 16 of the torsion bar 3 passes through the hole **8*a* of the bushing 8 so as to be rotatable therein; and is bent into a hole 9*a* of the sector-gear 9 so as to be secured thereto. The other end portion 17 of the torsion bar 3 is rotatably supported by the bracket 7. In addition, the support plate 2 is secured to a center portion 15 of the torsion bar 3 so as to be positioned at or in corresponding relationship to a central portion of the seat-back 1. Thus, as a whole, the support plate 2 is supported by the side-frames 4 and 5**.

The torsion bar 3 includes a central portion 15, a first end portion 16, a second end portion 17, a first bent portion 13 which is of a substantially reversed S-shape, and a second bent portion 14 which is of an S-shape. The first bent portion 13 is out of symmetry with the second bent portion 14 in the lateral direction of the seat-back 1.

In operation, when the knob 11 is rotated through an angle, the resultant rotation is transmitted by way of the braking mechanism 10 to the pinion-gear 12, which results in rotation of the sector-gear 9 about the bushing 8. Thus, the torsion bar 3 is rotated and therefore the support plate 2 is moved in the depth direction of the seat-back 1, with the result that the torsion bar 3 is deformed in this direction and an urging force from the support plate 2 to a back of an occupant (not shown) is adjusted. Due to the fact the deflection of the left side of the torsion bar 13 is larger than the deflection of the right side of the torsion bar 13 in light of the wider load receiving area of the left side than that of the right side, the load applied to the support plate 2 or the center portion of the torsion bar 3 can be equally distributed or transmitted to the left side of the torsion bar 3 and the right side of the torsion bar 3. It is to be noted that the support plate 2 can be omitted.

Figure 4:
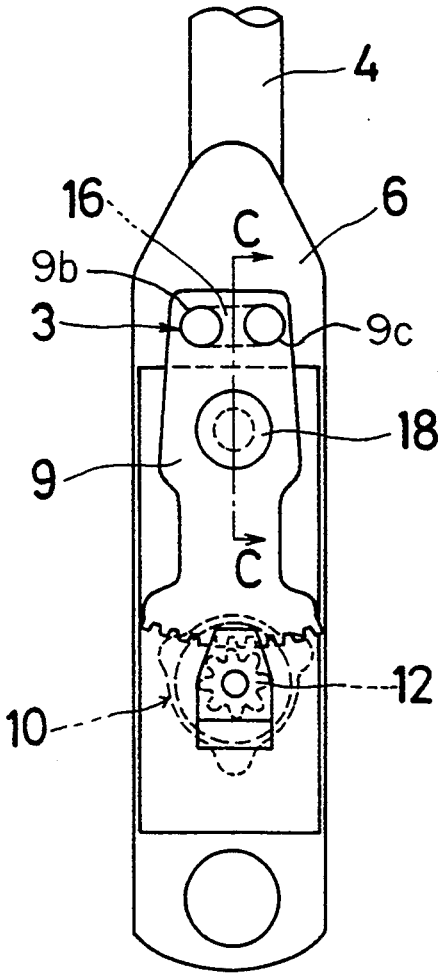
FIG. 4 is a side view of a second embodiment of a lumbar support device in accordance with the present invention.
Figure 5:
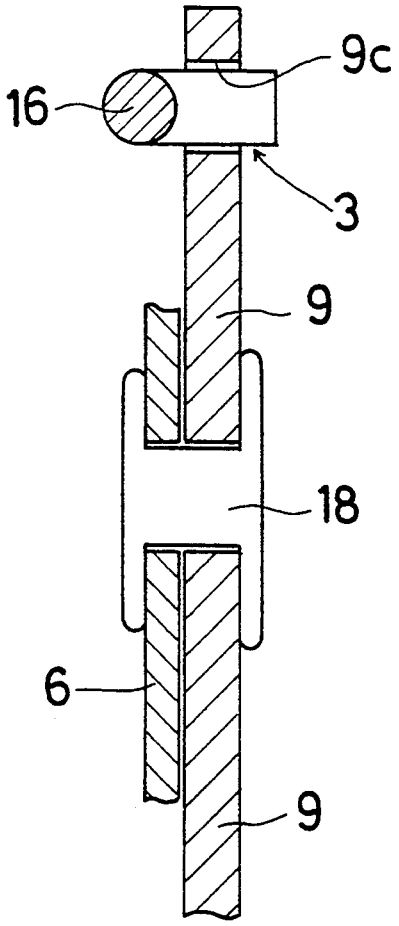
Fig. 5 is a cross-sectional view taken along line C—C in FIG. 4.

As shown in FIGS. 4 and 5, one end portion 16 of the torsion bar 3 can be formed into a hooked configuration which passes through holes **9*b* and 9*c* of the sector-gear 9, under which the sector-gear 9 is rotatably mounted on a pin 18** which does not have a hole.

Figure 6:
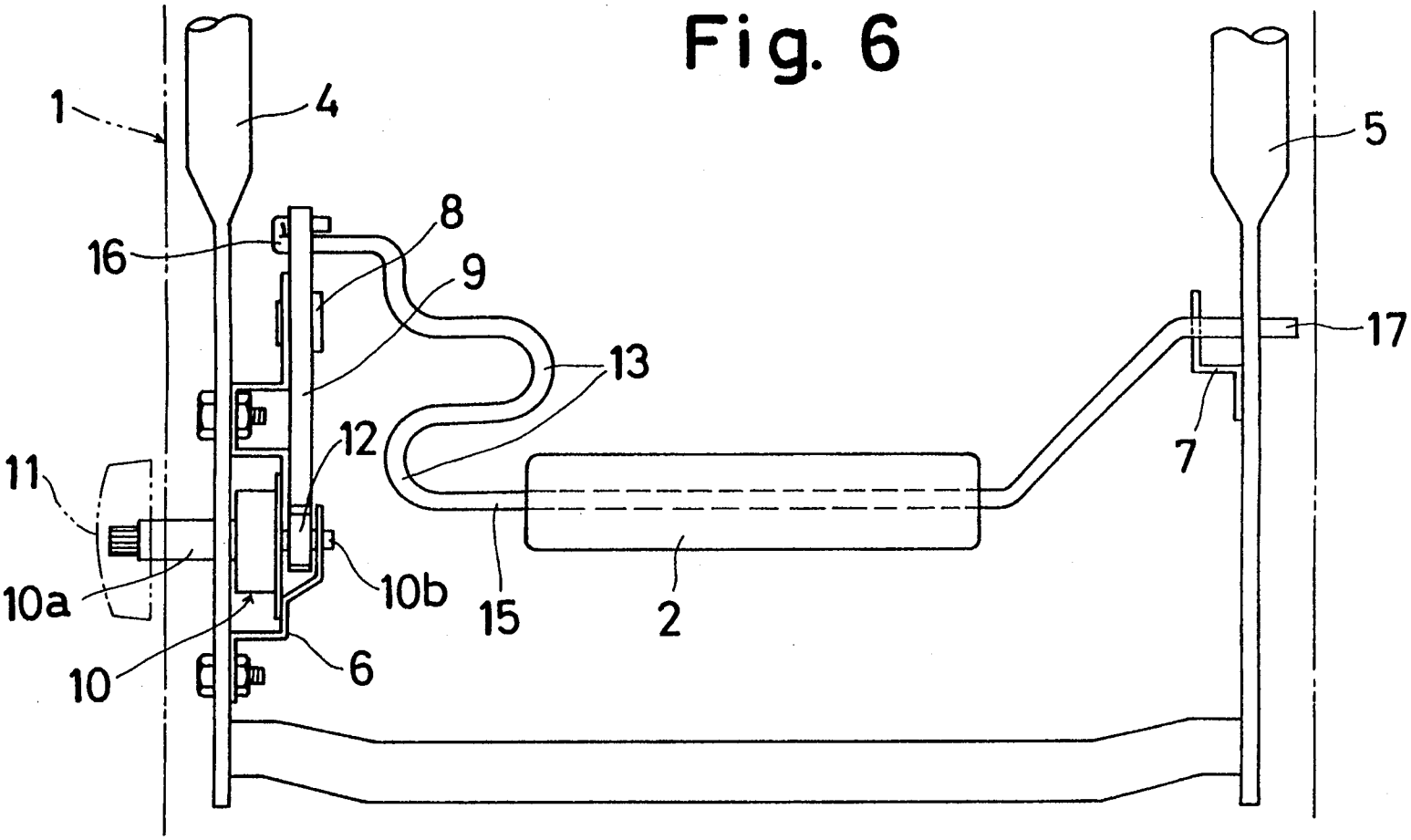
FIG. 6 is a front view of a third embodiment of a lumbar support device in accordance with the present invention.

In a third embodiment, as shown in FIG. 6, the right side of the torsion bar 3 can be formed into a straight-lined structure instead of the bent configuration.

As mentioned above, in accordance with the present invention, the equal distribution of the load from the right side and the left side of the torsion bar 3 to the occupant can be assured, which prevents discomfort to the occupant.

The principles, preferred embodiments, and modes of operation of the present invention have been described in the foregoing description. The invention which is intended to be protected herein should not, however, be construed as limited to the particular forms disclosed, as these are to be regarded as illustrative rather than restrictive. Variations and changes may be made by those skilled in the art without departing from the spirit of the present invention. Accordingly, the foregoing detailed description should be considered exemplary in nature and not limited to the scope and spirit of the invention as set forth in the appended claims.

What is claimed is:

1. A lumbar support device comprising:

a seat-back having a first upstanding frame and a second upstanding frame spaced therefrom in a lateral direction;

a bilateral asymmetrical torsion spring having a center portion, a first portion positioned at one side of said center portion, and a second portion positioned at the other side of said center portion, said first portion being formed into a bent configuration having a distal end and at least two laterally extending straight line portions which overlap each other in said lateral direction and being vertically spaced apart, said second portion having a distal end portion rotatably connected to said second upstanding frame, said first portion being larger than said second portion in area;

driving means disposed between said first upstanding frame and said distal end of said first side of said bilateral asymmetric torsion spring along a direction of thickness of said seat back; and a supporting plate in communication with said center portion of said bilateral asymmetric torsion spring.

2. The lumbar support device recited in claim 1 wherein said first portion of said bilateral asymmetric torsion spring has a reverse "S" shape.

3. The lumbar support device recited in claim 1 wherein said second portion of said bilateral asymmetric torsion spring is shaped into an inclined straight line.

4. The lumbar support device recited in claim 1 wherein said second portion of said bilateral asymmetric torsion spring has a "S" shape.

5. The lumbar support device recited in claim 1 wherein said driving means has a sector-gear; and a driven member pivotally attached to said first upstanding frame, said driven member supporting said distal end of said first portion of said bilateral asymmetric torsion spring.

* * * * *